US006033059A

United States Patent [19]

Wen et al.

[11] Patent Number: 6,033,059

[45] Date of Patent: Mar. 7, 2000

[54] PRINTER APPARATUS AND METHOD

[75] Inventors: Xin Wen, Rochester; Anthony R. Lubinsky, Penfield, both of N.Y.

[73] Assignee: Eastman Kodak Company, Rochester, N.Y.

[21] Appl. No.: 09/040,121

[22] Filed: Mar. 17, 1998

[51] Int. Cl.[7] ..... B41J 2/045

[52] U.S. Cl. ..... 347/71; 347/40; 347/94

[58] Field of Search ..... 347/40, 41, 42, 347/68, 69, 71, 94

[56] References Cited

U.S. PATENT DOCUMENTS

| | | | |
|---|---|---|---|
| 4,842,493 | 6/1989 | Nilsson . | |
| 4,887,100 | 12/1989 | Michaelis et al. . | |
| 4,992,808 | 2/1991 | Bartky et al. . | |
| 5,432,540 | 7/1995 | Hiraishi | 347/69 |
| 5,625,395 | 4/1997 | Imai | 347/71 |

FOREIGN PATENT DOCUMENTS

| | | |
|---|---|---|
| 9-29962 | 2/1997 | Japan . |

*Primary Examiner*—Joan Pendegrass
*Attorney, Agent, or Firm*—Walter S. Stevens

[57] ABSTRACT

Printer apparatus and method. The apparatus includes a substrate having a plurality of spaced-apart pairs of selectively actuatable side walls defining respective channels therebetween of different depths. Each channel receives an associated one of a plurality of ink bodies therein and the substrate is formed of piezoelectric material responsive to electric stimuli. The pairs of side walls are preferably separated one from another by means of an intervening cut-out for reducing mechanical coupling between the ink channels. A cover plate is connected to the substrate and has a plurality of orifices therethrough in registration with respective ones of the channels such that the orifices are off-set one from another. Accordingly, in one embodiment of the invention, the channels have different depths and, therefore, the orifices, which are in registration with the channels, are off-set one from another to accommodate the different depths of the channels. A selected ink channel, which belongs to a first group of channels having a first predetermined depth, pressurize as its pairs of side walls are actuated. Also, a non-selected ink channel, which belongs to a second group of channels having a second predetermined depth, remains unpressurized as the selected channel is actuated. Moreover, the two groups of channels are interleaved. The channels of the first group are actuated at a later time that the channels of the second group as the printhead traverses a receiver medium. This feature of the invention reduces mechanical and hydraulic coupling between channels because actuation of selected channels belonging the two groups are spaced-apart in time.

29 Claims, 14 Drawing Sheets

PRINTER APPARATUS AND METHOD

BACKGROUND OF THE INVENTION

The present invention generally relates to printer apparatus and methods and more particularly relates to a printer apparatus adapted to reduce cross-talk between ink channels therein, and method thereof.

An ink jet printer produces images on a receiver medium by ejecting ink droplets onto the receiver medium in an image-wise fashion. The advantages of non-impact, low-noise, low energy use, and low cost operation in addition to the capability of the printer to print on plain paper are largely responsible for the wide acceptance of ink jet printers in the marketplace.

However, one problem associated with piezoelectric ink jet printers is placement errors of the ink droplets on the receiver medium. Such errors are due, for example, to mechanical and/or hydraulic coupling (i.e., "cross-talk") between side-by-side ink channels comprising the ink jet printer's printhead. That is, each ink channel, which is defined by a pair of parallel side walls made of the piezoelectric material, may share a common side wall with an adjoining channel. When an ink channel is selected for ink ejection therefrom, an electrical pulse is supplied to the side walls defining the ink channel in order to cause movement of the side walls. A pressure surge occurs in the ink channel as the side walls move, which pressure surge causes an ink droplet to eject from the ink channel. However, movement of the side walls associated with the selected ink channel in order to cause a pressure surge therein may inadvertently cause a pressure surge in an adjoining non-selected ink channel. Therefore, the pressure surge produced in the adjoining non-selected channel may inadvertently eject an ink droplet from the non-selected channel. This is so because each channel shares a common side wall with an adjoining channel. Moreover, pressure change in a channel selected for actuation may affect pressure in a remote non-adjoining channel due to a so-called "domino effect". That is, if a first channel is selected for actuation, a second channel adjoining the first channel but not selected for actuation will see change in pressure because the first and second channels share common side walls. Accordingly, a third channel not selected for actuation but adjoining the second channel will see some change in pressure because the second and third channels share common side walls. This phenomenon, referred to herein as the "domino effect" occurs for the fourth channel, the fifth channel, and so on. Eventually, this propagating pressure surge, although diminishing in intensity, may reach another actuated channel which is being intentionally actuated simultaneously with the first channel to achieve the desired droplet image pattern. However, this second actuated channel will not only experience the expected pressure surge caused by its actuation, but may also experience an additional unexpected pressure surge component caused by the "domino effect", which is undesirable. Such mechanical coupling (i.e., cross-talk) between the channels interferes with precise ejection of ink droplets, which in turn reduces accuracy of ink droplet placement on the receiver medium.

In addition, when ink in a selected ink channel is pressurized, the pressure surge therein may be hydraulically communicated to ink in another channel because each ink channel is in fluid communication with a common manifold holding a supply of the ink. This latter phenomenon results in hydraulic cross-talk, which in turn may lead to inadvertent ejection of an ink droplet. In other words, hydraulic cross-talk causing inadvertent ejection of an ink droplet from the non-selected channel will also produce ink droplet placement errors on the receiver medium. These ink droplet placement errors in turn produce image artifacts such as banding, reduced sharpness, extraneous ink spots, ink coalescence and color bleeding.

Techniques to reduce cross-talk are known. An ink jet printhead having low mechanical over-coupling from one channel to another is disclosed in U.S. Pat. No. 4,842,493 titled "Piezoelectric Pump" issued Jun. 27, 1989 in the name of Kenth Nilsson. This patent discloses a piezoceramic wafer into which grooves have been sawed from the upperside and underside of the wafer. The grooves on the upperside and underside of the wafer lay offset relative to one another and partially overlap. The grooves on the upperside of the wafer eject ink droplets while the grooves on the underside of the wafer contain only air. In this manner, deformation of the walls of one ink groove is hardly at all transmitted to another ink groove because adjacent ink grooves are separated by an intervening air-filled groove.

Although the Nilsson device provides for low "cross-talk", the Nilsson device does not appear to provide means for reducing hydraulic cross-talk and also does not appear to provide means to further reduce mechanical cross-talk to a level less than that achieved only with the intervening air-filled grooves.

Therefore, there has been a long-felt need to provide a printer apparatus suitably adapted to reduce cross-talk between ink channels therein, and method thereof.

SUMMARY OF THE INVENTION

The invention resides in a printer apparatus, comprising a substrate including a plurality of pairs of side walls off-set one from another, each pair of the side walls defining a channel therebetween; and a cover connected to the substrate and having a plurality of orifices in registration with respective ones of the channels.

According to one aspect of the invention, the apparatus includes a substrate having a plurality of spaced-apart pairs of actuatable side walls. Each pair of side walls can be selected for actuation independently of other pairs of side walls. Also, each pair of side walls defines an ink channel therebetween. Neighboring ink channels may have different channel depths. Each channel receives an associated one of a plurality of ink bodies therein and the substrate itself is formed of piezoelectric material responsive to electric stimuli. The pairs of side walls are preferably separated one from another by means of an intervening cut-out for reducing mechanical coupling between the ink channels. A cover plate is connected to the substrate and has a plurality of orifices therethrough in registration with respective ones of the channels. The orifices are "in registration" with their respective ink channels in the sense that each orifice is aligned with a longitudinal axis of its associated ink channel. Preferably, each set of orifices is associated with a set of channels of a given depth. That is, the channels have different depths and, therefore, the orifices, which are in registration with the channels, are off-set one from another due to the different depths of the channels. A selected ink channel, which belongs to a first group channels having a first predetermined depth, is pressurized as its pairs of side walls are actuated. Also, a non-selected ink channel, which belongs to a second group of channels having a second predetermined depth, remains unpressurized as the selected channel is actuated. Moreover, the two groups of channels are interleaved. Hence, the channels of the first group are necessarily actuated at a later time that the channels of the second group as the printhead traverses a receiver medium. This feature of the invention reduces mechanical and hydraulic coupling between the ink bodies residing in neighboring channels because actuation of selected channels belonging the two groups are spaced-apart in time.

The invention further comprises a plurality of electrodes connected to respective pairs of the side walls for actuating the side walls, so that the side walls move when actuated. A pulse generator is coupled to the actuators for supplying an electrical pulse to the actuators, so that the actuators are actuated with a predetermined pulse shape. Moreover, a controller is connected to the pulse generator for controlling the pulse generator, so that the pulse generator controllably supplies the predetermined pulse shape at predetermined times.

An object of the present invention is to provide a printer apparatus adapted to reduce hydraulic and mechanical cross-talk between ink channels therein, and method thereof.

A feature of the present invention is the provision of a printhead having a cutout between neighboring ink channels for mechanically decoupling the ink channels.

Another feature of the present invention is the provision of a nozzle plate bonded to the printhead and having a plurality of orifices in registration (i.e., aligned) with respective ones of the channels, the orifices being off-set one from another for mechanically and hydraulically decoupling the ink channels.

Yet another feature of the present invention is the provision of a nozzle plate bonded to the printhead and having a plurality of orifices in registration (i.e., aligned) with respective ones of the channels, the orifices being off-set one from another for hydraulically decoupling the ink channels.

An advantage of the present invention is that mechanical "cross-talk" between neighboring ink channels is reduced to a level less than that achieved only with intervening air-filled grooves.

Another advantage of the present invention is that hydraulic "cross-talk" between neighboring ink channels is reduced.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DESCRIPTION OF PREFERRED EMBODIMENTS OF THE INVENTION

Figures 1A, 1B:
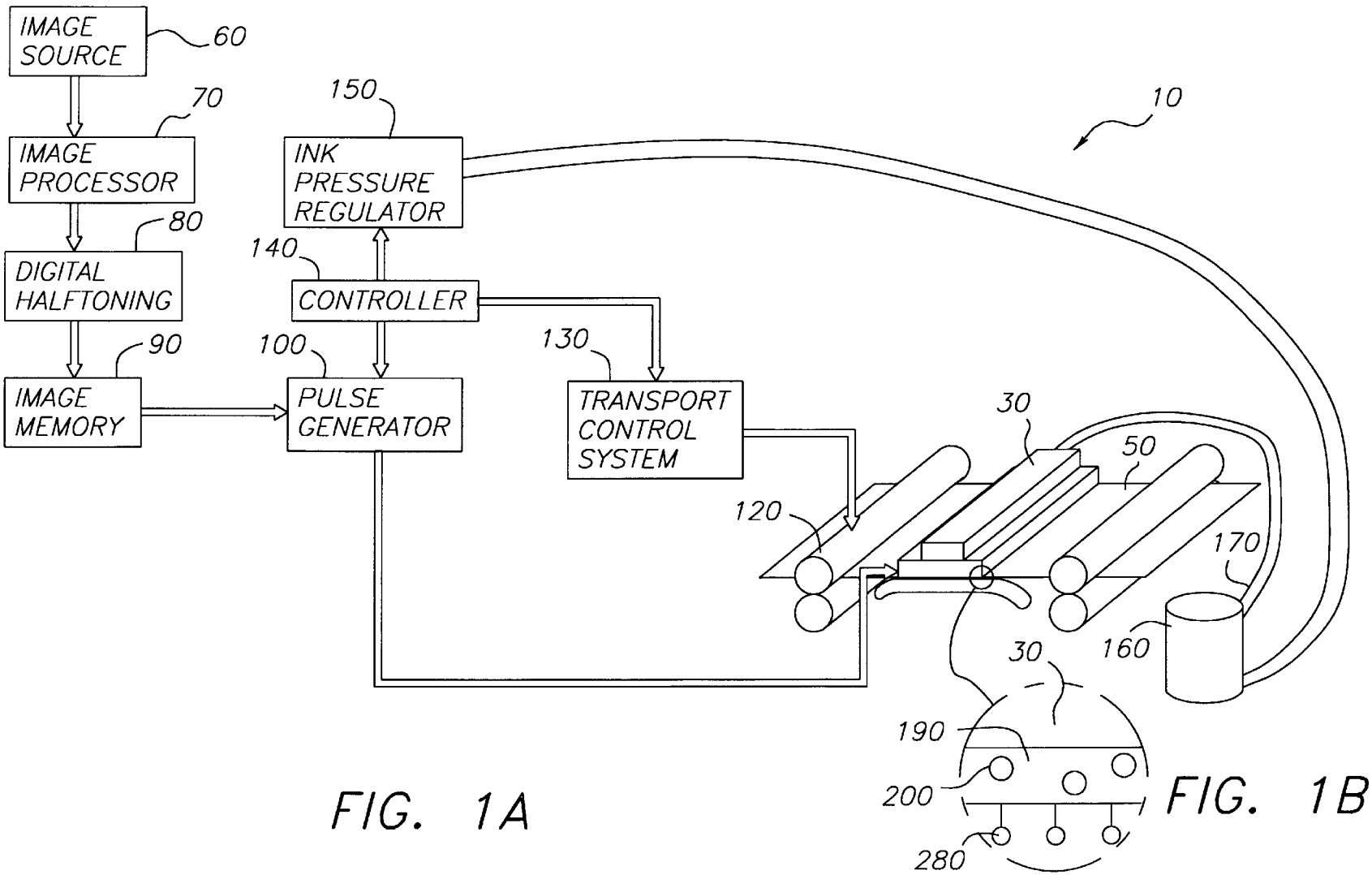
FIG. 1 illustrates a printer apparatus belonging to the present invention, the printer apparatus comprising a printhead having a plurality of ink channels formed therein and an attached nozzle plate having a plurality of off-set orifices in registration with respective ones of the ink channels.

The present description will be directed in particular to elements forming part of, or cooperating more directly with, apparatus in accordance with the present invention. It is to be understood that elements not specifically shown or described may take various forms well known to those skilled in the art.

Therefore, referring to FIGS. 1, 2, 3, 4 and 5, there is shown a printer apparatus, generally referred to as 10, adapted to reduce "cross-talk" (i.e., mechanical and/or hydraulic coupling) between a plurality of spaced-apart elongate ink channels, such as first ink channel 20*a* and second ink channel 20*b*, each channel 20*a*/20*b* being adapted to receive an ink body 22 therein. First ink channel 20*a* and second ink channel 20*b* are formed in a printhead 30 for on-demand ejection of an ink droplet 40 therefrom that travels toward a receiver 50, which may be paper or transparency. Each of the channels 20*a*/20*b* has a channel outlet 25 at an end 27 thereof and an open side 28. Moreover, channels 20*a*/20*b* may have different depths "A" and "B", as measured from the top to the bottom thereof, for reasons disclosed hereinbelow. For reasons described in detail hereinbelow, channels 20*a*/20*b* are interleaved and, therefore, no two channels having the same depth (whether "A" or "B") neighbor each other. Channels 20*a* having depth "A" and channels 20*b* having depth "B" together define a first group of channels denoted herein as group "AB", for reasons described hereinbelow. Moreover, the grouping "AB" may be arranged in a repeating series "AB, AB", as shown.

As shown in FIGS. 1, 2, 3, 4 and 5, printer apparatus 10 comprises an image source 60, which may be raster image data from a scanner or computer, or outline image data in the form of a PDL Page Description Language) or other form of digital image representation. This image data is transmitted to an image processor 70 connected to image source 60. Image processor 70 converts the image data to a pixel-mapped page image. Image processor 70 may be a raster image processor in the case of PDL image data to be converted, or a pixel image processor in the case of raster image data to be converted. In any case, image processor 70 transmits continuous tone data to a digital halftoning unit 80 connected to image processor 70. Halftoning unit 80 halftones the continuous tone data produced by image processor 70 and produces halftoned bitmap image data that is stored in an image memory 90, which may be a full-page memory or a band memory depending on the configuration of printer apparatus 10. A pulse generator 100 connected to image memory 90 reads data from image memory 90 and applies time and amplitude varying electrical pulses to an electrical actuator 110 (i.e., an electrode), for reasons described more filly hereinbelow.

Figure 2:
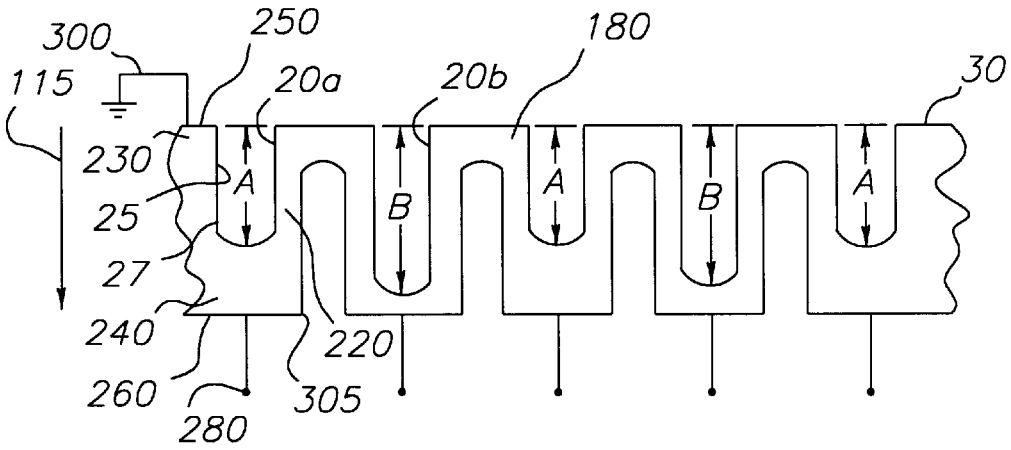
FIG. 2 is a fragmentation view in elevation of the printhead with the nozzle plate removed, this view showing ink channels of different depths, each pair of ink channels having a cutout therebetween.

As best seen in FIGS. 1 and 2, printhead 30 is moved in a direction 115 relative to receiver 50 by means of a transport mechanism 120, which is electronically controlled by a transport control system 130. Transport control system 130 in turn is controlled by a suitable controller 140. It may be appreciated that different mechanical configurations for transport control system 130 are possible. For example, in the case of pagewidth printheads, it is convenient to move receiver 50 past a stationary printhead 30. On the other hand, in the case of scanning-type print systems, it is more convenient to move printhead 30 along one axis (i.e., a "sub-scanning" direction) and receiver 50 along an orthogonal axis (i.e., a "main scanning" direction), in relative raster motion.

Still referring to FIGS. 1 and 2, controller 140 may be connected to an ink pressure regulator 150 for controlling regulator 150. Regulator 150 is capable of regulating pressure in an ink reservoir 160. Ink reservoir 160 is connected, such as by means of a conduit 170, to printhead 30 for supplying liquid ink to printhead 30. In this regard, ink is preferably distributed under controlled negative pressure to a back surface of printhead 30 by an ink channel device (not shown) belonging to printhead 30 and from there into channels 20*a*/20*b*.

Figure 3:
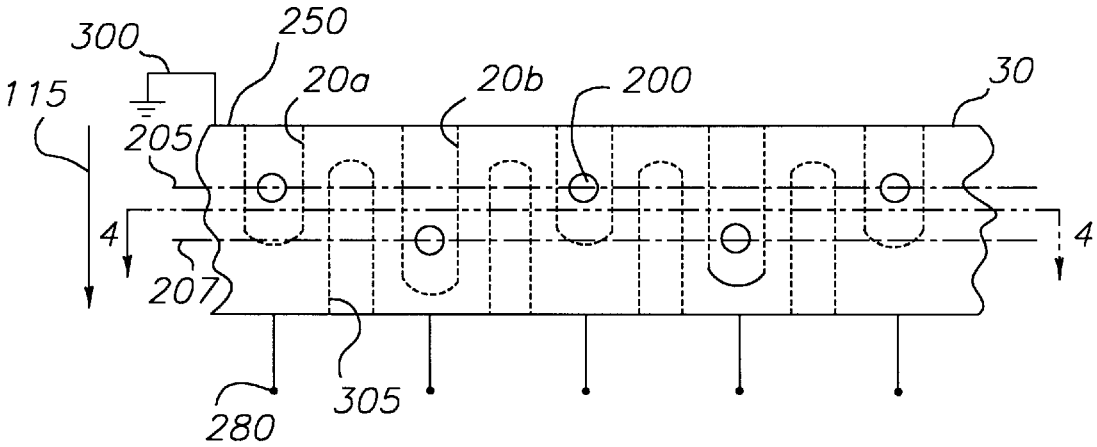
FIG. 3 is a view in elevation of the printhead with the nozzle plate present.
Figure 5:
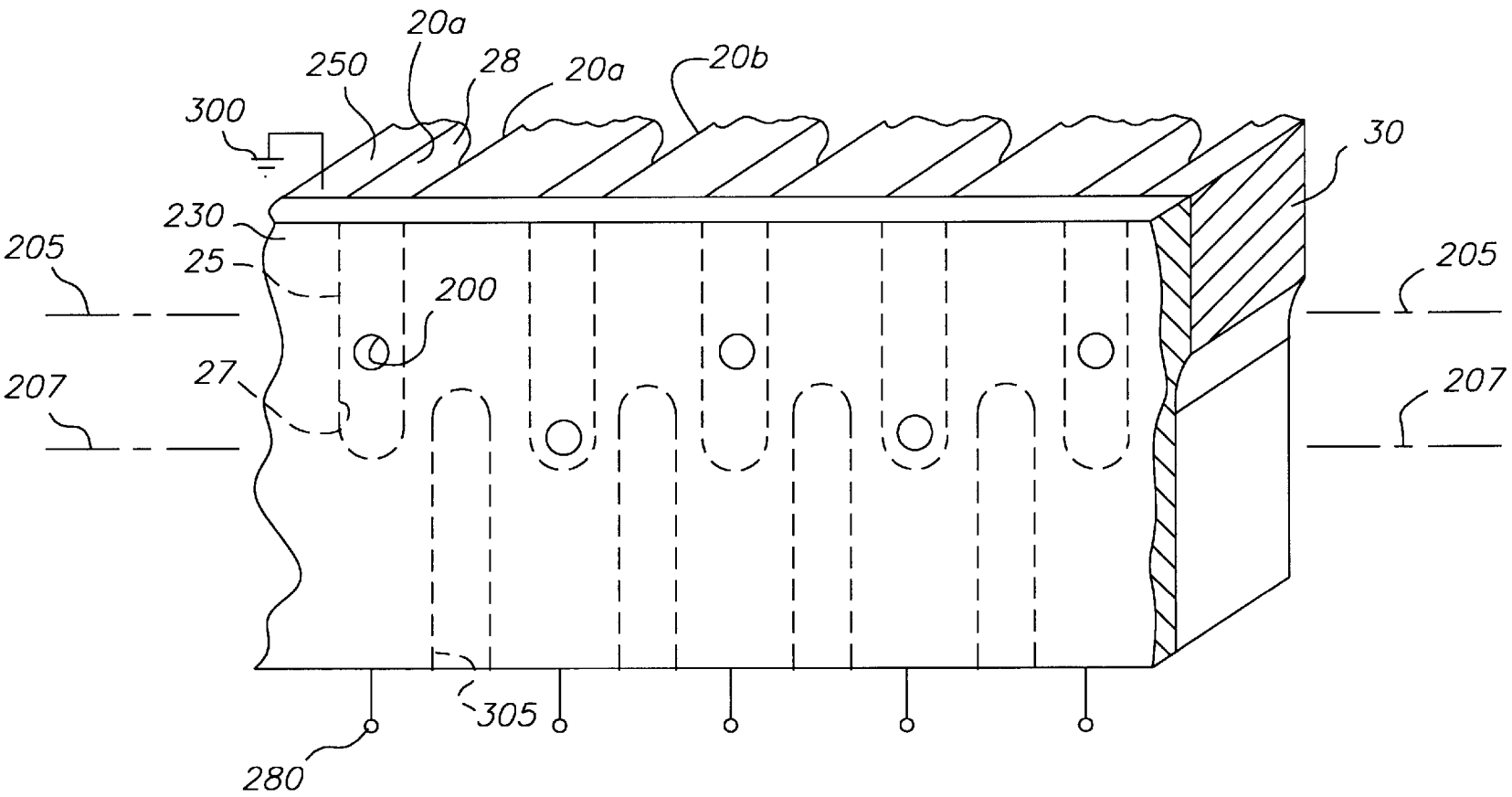
FIG. 5 is a view in perspective of the printhead.
Figure 6:
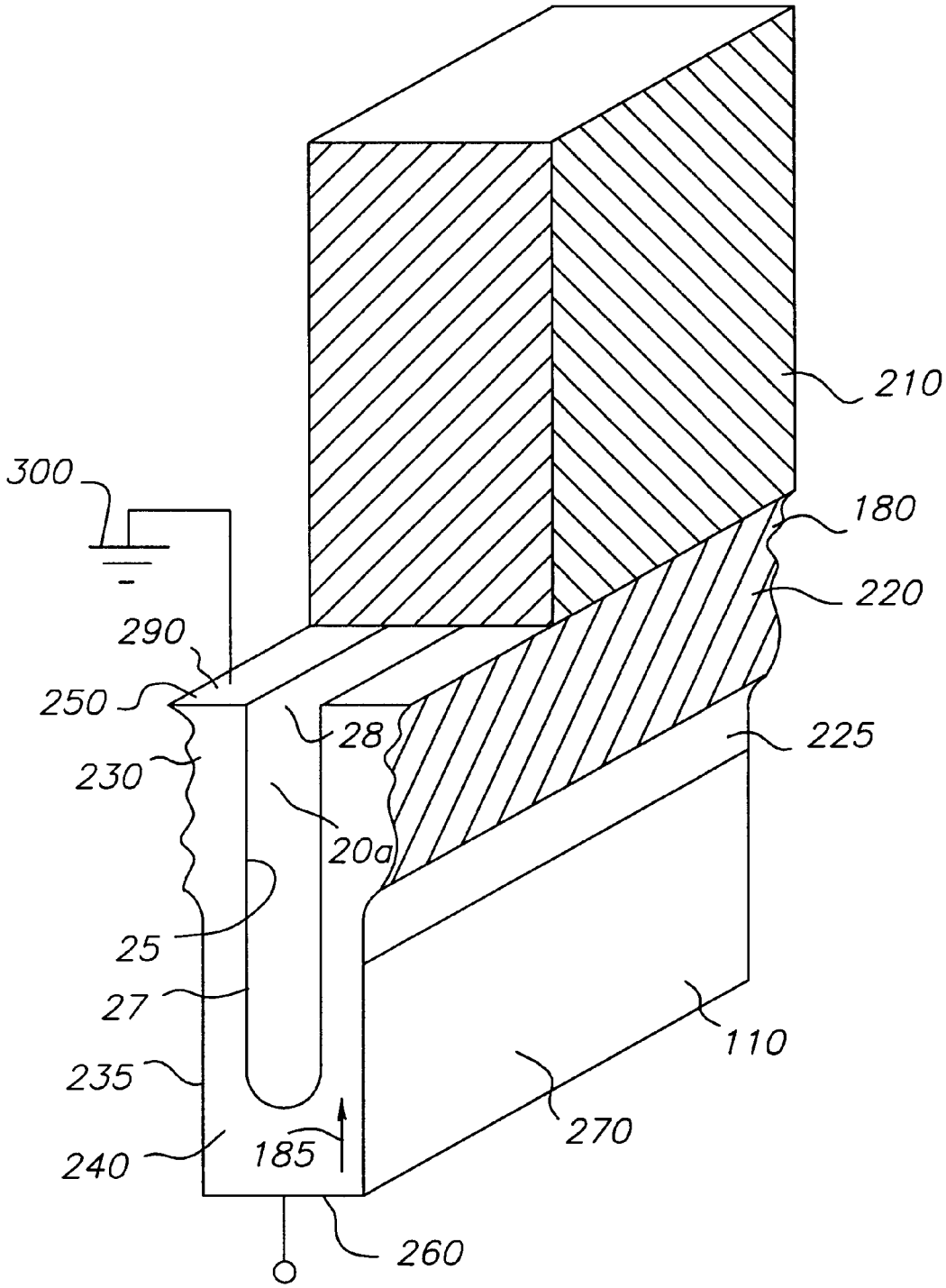
FIG. 6 is a fragmentation view in perspective of one of the ink channels.
Figure 7:
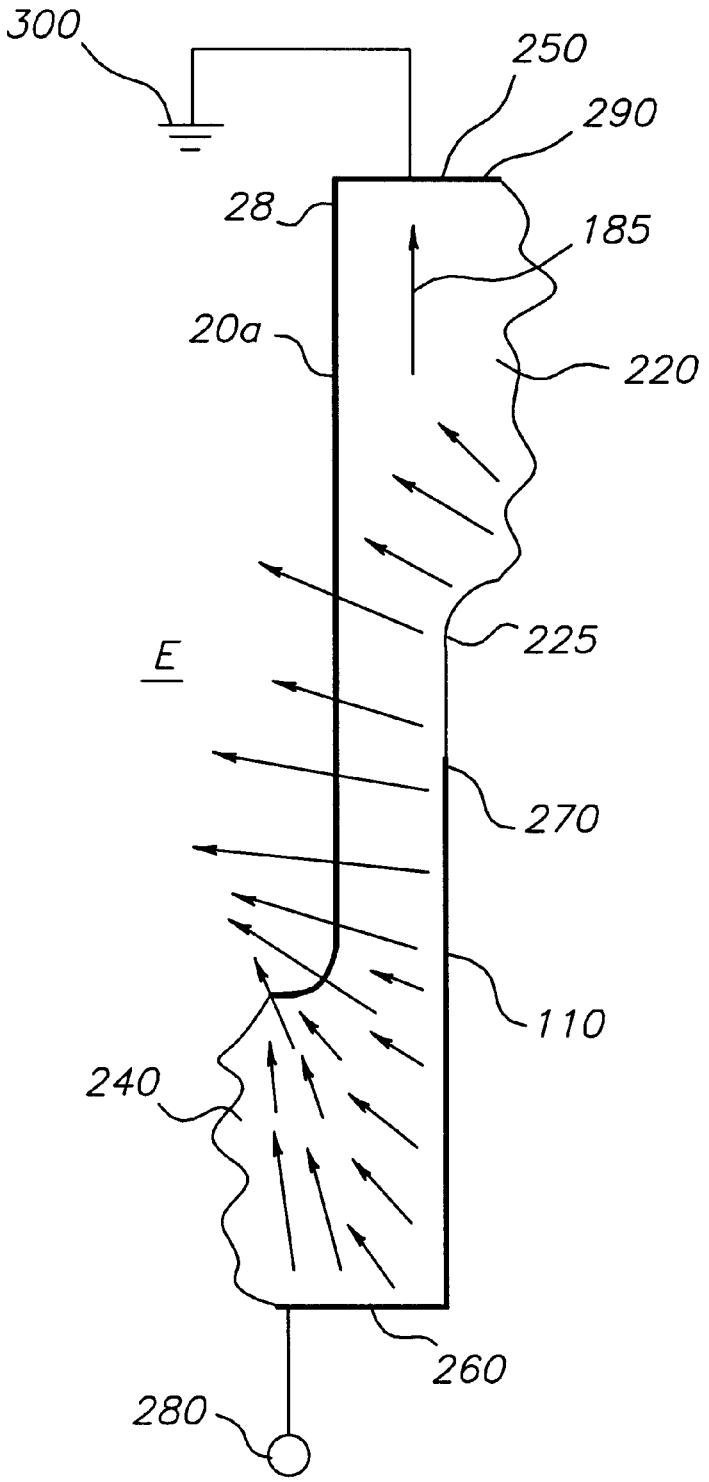
FIG. 7 is a view in elevation of one-half portion of one of the ink channels, this view showing direction of an electric field applied to the ink channel.
Figure 8:
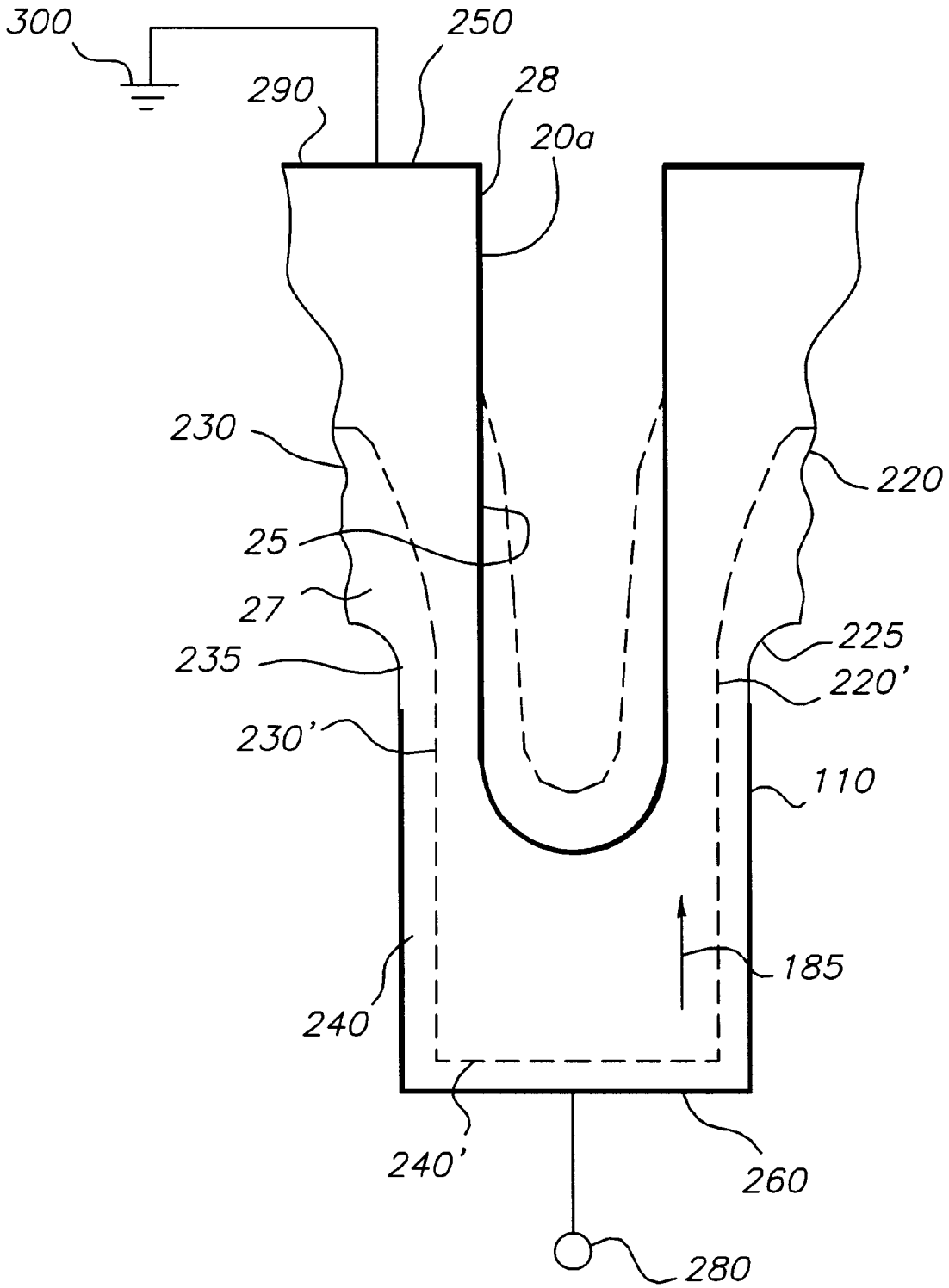
FIG. 8 is a view in elevation of one of the ink channels.
Figure 9A:
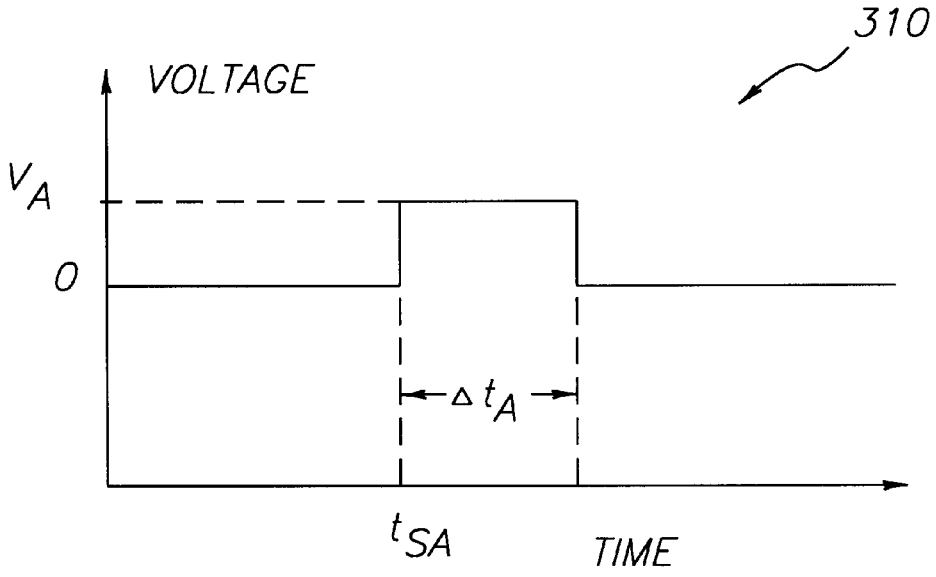
FIG. 9*a* is a graph illustrating a first "square-wave" electrical pulse as a function of time applied to a first one of the ink channels, the first "square-wave" electrical pulse having a predetermined amplitude, width and start time.
Figure 9B:
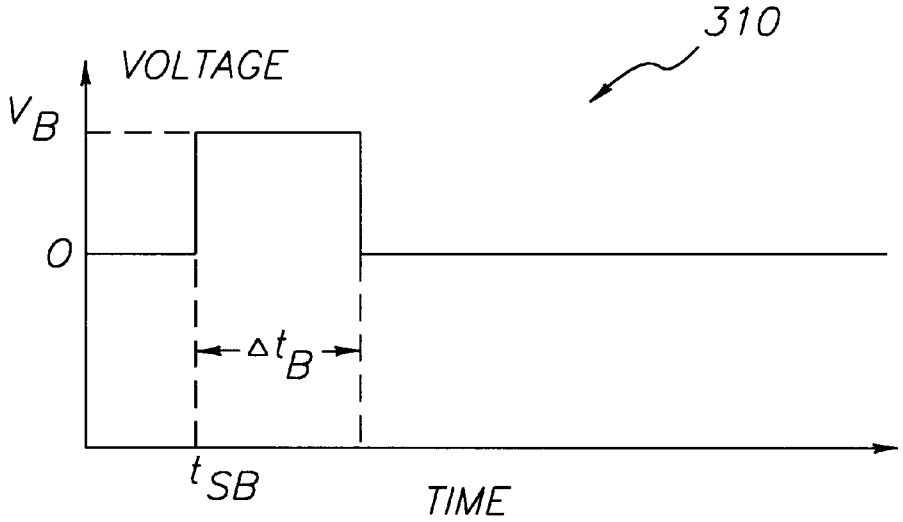
FIG. 9*b* is a graph illustrating a second "square-wave" electrical pulse as a function of time applied to a second one of the ink channels, the second "square-wave" electrical pulse having a predetermined amplitude, width and start time starting before the start time of the first "square-wave" electrical pulse.

Referring now to FIGS. 3, 5 and 6, printhead 30 comprises a generally cuboid-shaped preferably one-piece substrate 180 formed of a piezoelectric material, such as lead zirconium titanate (PZT), which is responsive to electrical stimuli. In the preferred embodiment of the invention, piezoelectric substrate 180 is poled generally in the direction of an arrow 185. Of course, the poling direction may be oriented in other directions, if desired, such as in a direction perpendicular to the poling direction shown by arrow 185. Cut into substrate 180 are the previously mentioned plurality of elongate ink channels 20*a*/20*b*. Ink channels 20*a*/20*b* are covered at outlets 25 by a nozzle plate 190 having a plurality of orifices 200 preferably aligned in registration with respective ones of channels 20*a*/20*b*, so that ink droplets 40 are ejected from channel outlets 25 and through orifices 200. Orifices 200 are "in registration" with their respective ink channels 20*a*/20*b* in the sense that each orifice 200 is aligned with a longitudinal axis of its associated ink channel 20*a*/20*b*. Preferably, each set of orifices is associated with a set of channels of a given depth. That is, channels 20*a* have a different channel depth compared to channels 20*b* and, therefore, orifices 200, which are in registration with the channels 20*a*/20*b*, are off-set one from another due to the different channel depths of channels 20*a*/20*b*. As previously mentioned, channels 20*a* and 20*b* may have the different channel depths "A" and "B, respectively. Moreover, the orifices 200 associated with channels 20*a* having depth "A" are horizontally aligned along a first axis 205. Similarly, the orifices 200 associated with channels 20*b* having depth "B" are horizontally aligned along a second axis 207. The vertical locations of orifices 22 relative the bottom of their corresponding channels 20*a* and 20*b* can be chosen to optimize the properties of the ink droplets ejected from the channels 20*a* and 20*b* so that, if desired, ink droplets 40 having essentially identical physical properties can be ejected from channels 20*a* and 20*b*. Ink properties include ink droplet volume, speed, and the like. Off-set orifices 200 associated with the shallower channels 20*a* have additional piezoelectric material below the shallower channels 20*a* to provide somewhat more mechanical energy to these channels 20*a*, in order to compensate for the offset location of their orifices 200. Of course, neighboring orifices 200, which are off-set one from another, may be located at optimized positions relative to their corresponding channels 20*a*/20*b* which have different depths "A" and "B". It is understood that other locations of orifices 200 can occur for channels 20*a* and 20*b* in order to optimize ink droplet properties. When printhead 30 travels in direction of arrow 115, the off-set positions of the neighboring orifices 200 permit ink droplets 40 to be actuated and ejected at different times in neighboring channels 20*a* and 20*b* so that mechanical and/or hydraulic cross-talk between channels 20*a*/20*b* are reduced.

Figure 4:
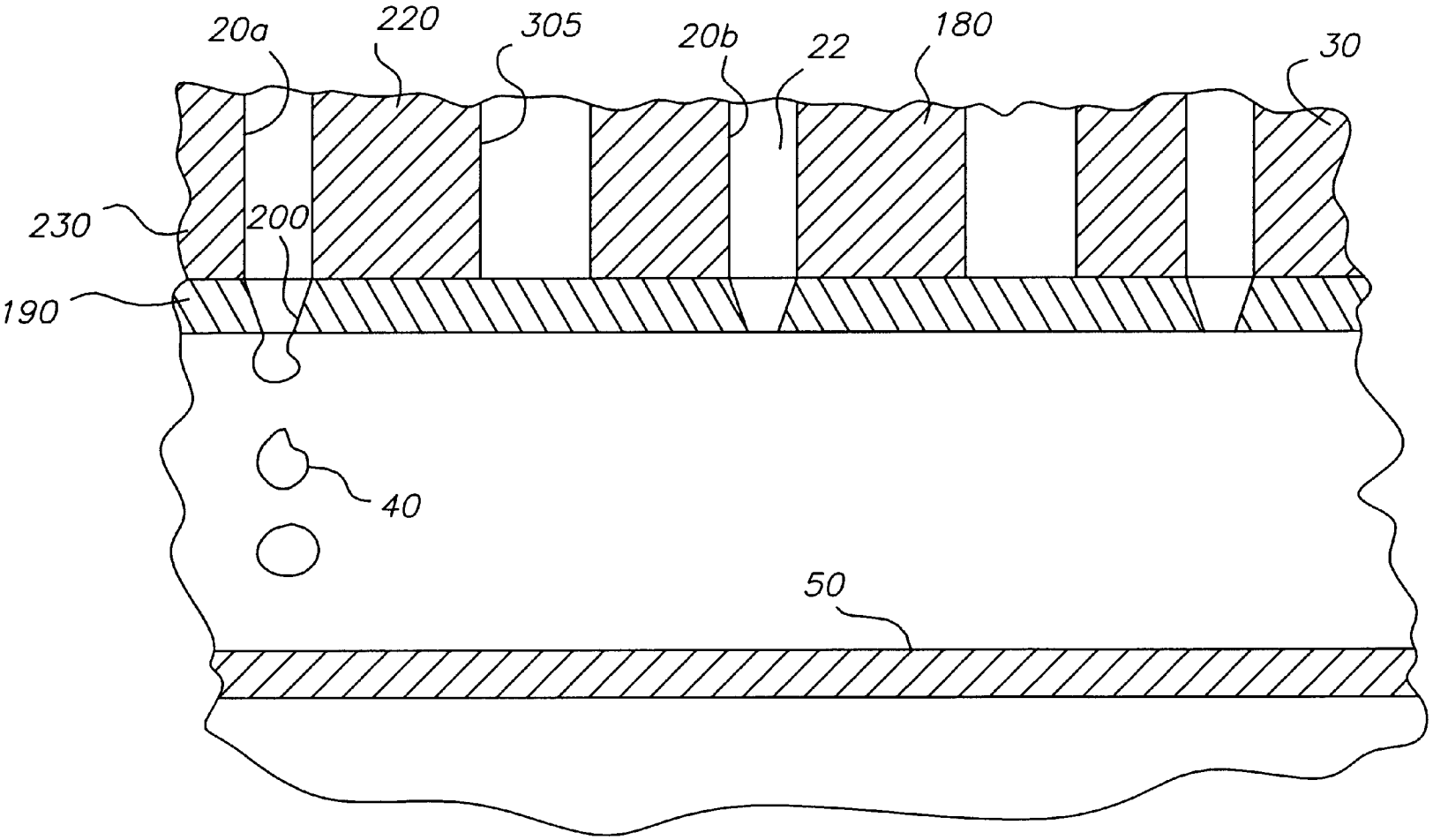
FIG. 4 is a view taken along section line 4—4 of FIG. 3.

Referring to FIGS. 4, 5 and 6, nozzle plate 190 is connected to substrate 180, such as being bonded thereto by a suitable adhesive. A rear cover plate (not shown) is also provided for capping the rear of channels 20*a*/20*b*. In addition, a top cover plate 210 caps channels 20*a*/20*b* along open sides 28. During operation of apparatus 10, ink from reservoir 160 is controllably supplied to the previously mentioned ink channel device (not shown) by means of conduit 170 and from there into each channel 20*a*/20*b*.

Referring to FIGS. 2, 3, 6 and 7, the specific structure of substrate 180 will now be described. Substrate 180 comprises a plurality of spaced-apart pairs of actuatable side walls 220/230. That is, substrate 180 includes a plurality of first side walls 220 and a plurality of opposing second side walls 230, each pair of side walls 20*a*/20*b* defining respective channels 20*a*/20*b* therebetween. Neighboring channels 20*a*/20*b* have the previously mentioned different depths "A" and "B", respectfully. Each pair of side walls 220/230 can be selected for actuation independently of other pairs of side walls 220/230. Each channel 20*a*/20*b* is adapted to receive ink body 200 therein. First side wall 220 includes an outside surface 225 and second side wall 230 includes an outside surface 235. Substrate 180 also includes a base portion 240 interconnecting first side wall 220 and second side wall 230, so as to form a generally U-shaped piezoelectric structure. Upper-most surfaces (as shown) of first wall 220 and second wall 230 together define a top surface 250 of substrate 180 and a lower-most surface (as shown) of base portion 240 defines a bottom surface 260 of substrate 180. An addressable electrode actuator layer 270 extends from approximately half-way up outside surface 225, across bottom surface 260, to approximately half-way up outside surface 235. However, it may be understood that electrode actuator layer 270 may extend any suitable distance up surfaces 225 and 235, such as, for example all the way up surfaces 225 and 235. Moreover, actuator layer 270 is connected to the previously mentioned pulse generator 100. Pulse generator 100 supplies electrical drive signals to actuator layer 270 by means of electrical conducting terminal 280.

Referring yet again to FIGS. 2, 3, 6 and 7, a common electrode layer 290 coats each channel 20*a*/20*b* and also extends therefrom along top surface 250. Common electrode layer 290 is preferably connected to a ground electrical potential, as at a point 300. In this configuration of the invention, an electrical field "E" is established between electrode actuator layer 270 and common electrode layer 290 in a predetermined orientation with respect to poling direction 185. Alternatively, common electrode layer 290 may be connected to pulse generator 100 for receiving electrical drive signals therefrom. However, it is preferable to maintain common electrode layer 290 at ground potential because common electrode layer 290 is in contact with liquid ink in channel 20*a*/20*b*. That is, it is preferable to maintain common electrode layer 290 at ground potential in order to minimize electrolysis effects on common electrode layer 290 when in contact with liquid ink in channels 20*a*/20*b*, which electrolysis may otherwise act to degrade performance of common electrode layer 290 as well as the ink.

As best seen in FIG. 2, each ink channel 20*a*/20*b* is separated from its neighbor by a cutout 305, which may be filled with air or a resilient shock-absorbing elastomer (not shown), for reducing mechanical "cross-talk" between channels 20*a*/20*b*. This is so because, when either side wall 220 or 230 laterally moves, it will move into cutout 305 rather than move into channel 20*a*/20*b*. Also, there is a need for reducing hydraulic cross-talk between ink channels 20*a*/20*b*. This is so because, as previously mentioned, reservoir 160 supplies ink to the ink channel device (not shown). Each channel 20*a*/20*b* is in fluid communication with the ink channel device. Thus, a pressure surge in one channel may be inadvertently communicated to another ink channel due to the ink channels having common communication with the ink channel device. This hydraulic cross-talk between neighboring channels is lessened by use of the invention because channels 20*a*/20*b* are not activated simultaneously. This in turn lessens the amplitude of inadvertent pressure surges occurring in channel 20*a* (or channel 20*b*). Hydraulic cross-talk between the channels 20*a*/20*b* is undesirable because such cross-talk would otherwise interfere with precise ejection of ink droplets 20 from channels 20*a*/20*b*. Interference with precise ejection of ink droplets 20 in turn reduces accuracy of ink droplet placement on receiver medium 30. Thus, each cutout 305 is defined between respective pairs of side walls 220/230, so that channels 20*a*/20*b* are mechanically decoupled by presence of cutouts 305. Also, both mechanical and hydraulic cross-talk is lessened because channels 20*a* and 20*b* are not activated simultaneously.

Referring now to FIGS. 8, 9*a*, 9*b*, 10*a* and 10*b*, there is shown substrate 180 undergoing deformation in order to pressurize ink bodies 200 residing in either channels 20*a* or channels 20*b* so as to eject ink droplet 40 along an ejection path preferably normal to orifice 200. To achieve pressurization of ink body 200, pulse generator 100 supplies an electrical pulse 310 to actuator layer 270. As previously mentioned, side walls 220/230 of channels 20*a* are actuated to move at a predetermined time after side walls 220/230 of channel 20*b*, as printhead 30 travels in direction of arrow 115. In this manner, mechanical cross-talk between channels 20*a*/20*b* is further reduced to a level less than the amount of reduction in cross-talk due to presence of cutouts 305 alone. More specifically, pulse generator 100 in combination with controller 140 controls timing of movement of the pairs of side walls 220/230 associated with each channel 20*a*/20*b*. That is, pulse 310 is applied individually to channels 20*a* and 20*b* at different starting times. In this regard, pulse 310 has a predetermined amplitude $V_A$, a predetermined pulse width $\Delta t_A$ and a predetermined pulse start time $t_{sA}$ when pulse 310 is applied to actuator layer 270 which is associated with channel 20*a*. Similarly, pulse 310 has a predetermined amplitude $V_B$, a predetermined pulse width $\Delta t_B$ and a predetermined pulse start time $t_{sB}$ when pulse 310 is applied to actuator layer 270 which is associated with channel 20*b*. However, start time $t_{sA}$ occurs after $t_{sB}$. Also, it may be appreciated that amplitudes $V_A$ and $V_B$ may differ in order to compensate for different electro-mechanical effects occasioned by grouping channels 20*a*/20*b* into group AB. In this regard, the presence of channels 20*a*/20*b* having different depths "A" and "B" may give rise to different electro-mechanical effects (e.g., different ink droplet volume, different ink droplet ejection speed, and other effects). The invention is capable of compensating for these different electro-mechanical effects, which may be caused by the different channel depths, by allowing for different voltage amplitudes $V_A$ and $V_B$, if desired.

Referring now to FIGS. 8, 9*a*, 9*b*, 10*a* and 10*b*, piezoelectric substrate 180, which is responsive to the electrical stimuli supplied to actuator layer 270 by pulse 310, deforms such that first side wall 220 and second side wall 230 inwardly move to positions 220' and 230', as shown by phantom lines. Moreover, base portion 240 will likewise inwardly move to position 240', as shown by phantom lines. It should be appreciated that first side wall 220, second side wall 230 and base portion 240 move due to the inherent nature of piezoelectric materials, such as the PZT piezoelectric material forming substrate 180. In this regard, it is known that when an electrical signal is applied to a piezoelectric material, mechanical distortion occurs in the piezoelectric material. This mechanical distortion is dependent on the poling direction and the direction of the applied electrical field "E". Thus, according to the present invention, electric field "E" is in a direction generally parallel to poling direction 185 near base portion 240 in order to cause base portion 240 to deform and compress to position 240' in non-shear mode. In addition, electric field "E" is in a direction generally perpendicular to poling direction 185 near side walls 220/230 to cause side walls 220/230 to deform to positions 220'/230' in shear mode. That is, side walls 220/230 will deform into a generally parallelogram shape, rather than the compressed shape in which base portion 240 deforms. In this manner, substrate 180 becomes longer and thinner in a direction parallel to poling direction 185. Once electrical pulse 310 ceases, side walls 220/230 and base portion 240 return to their undeformed positions to await further electrical excitation.

Figure 10A:
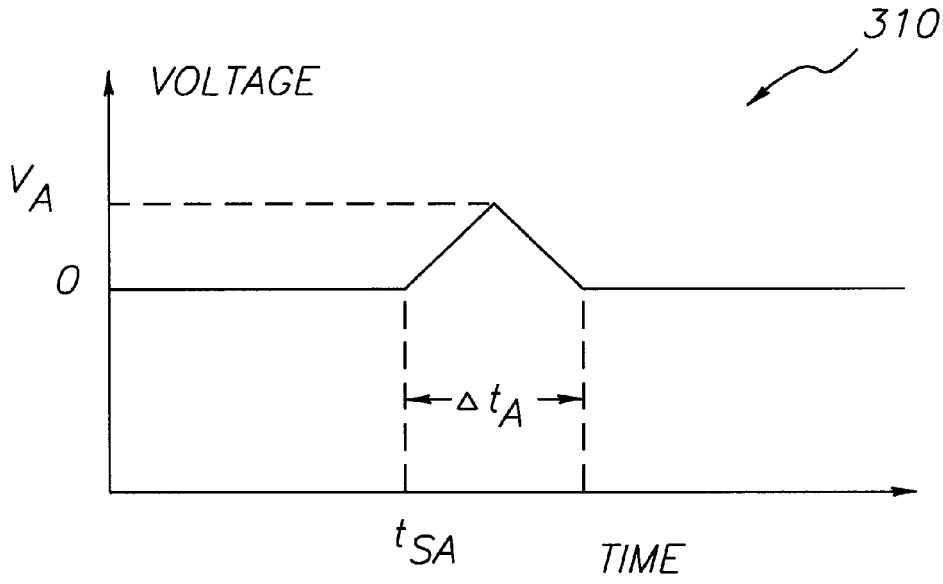
FIG. 10*a* is a graph illustrating a "triangular-wave" first electrical pulse as a function of time applied to a first one of the ink channels, the first "triangular-wave" electrical pulse having a predetermined amplitude, width and start time.
Figure 10B:
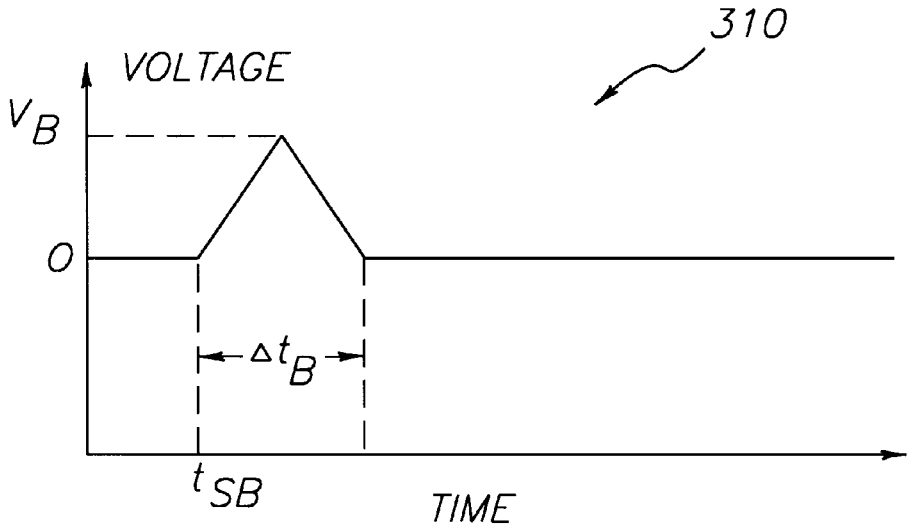
FIG. 10*b* is a graph illustrating a second "triangular-wave" electrical pulse as a function of time applied to a second one of the ink channels, the second "triangular-wave" electrical pulse having a predetermined amplitude, width and start time starting before the start time of the first "triangular-wave" electrical pulse.
Figure 11A:
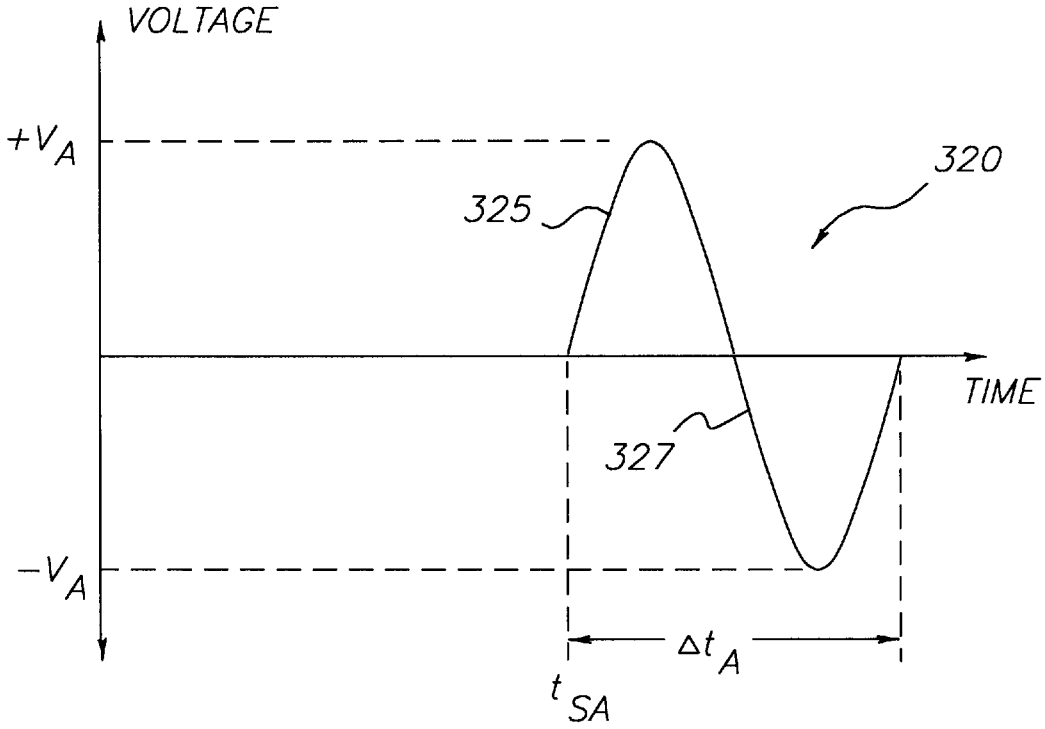
FIG. 11*a* is a graph illustrating a "sinusoidally-varying" first electrical pulse as a function of time applied to a first one of the ink channels, the first "sinusoidally-varying" electrical pulse having a predetermined amplitude, width and start time, the first "sinusoidally-varying" electrical pulse also having a positive polarity portion and a negative polarity portion.
Figure 11B:
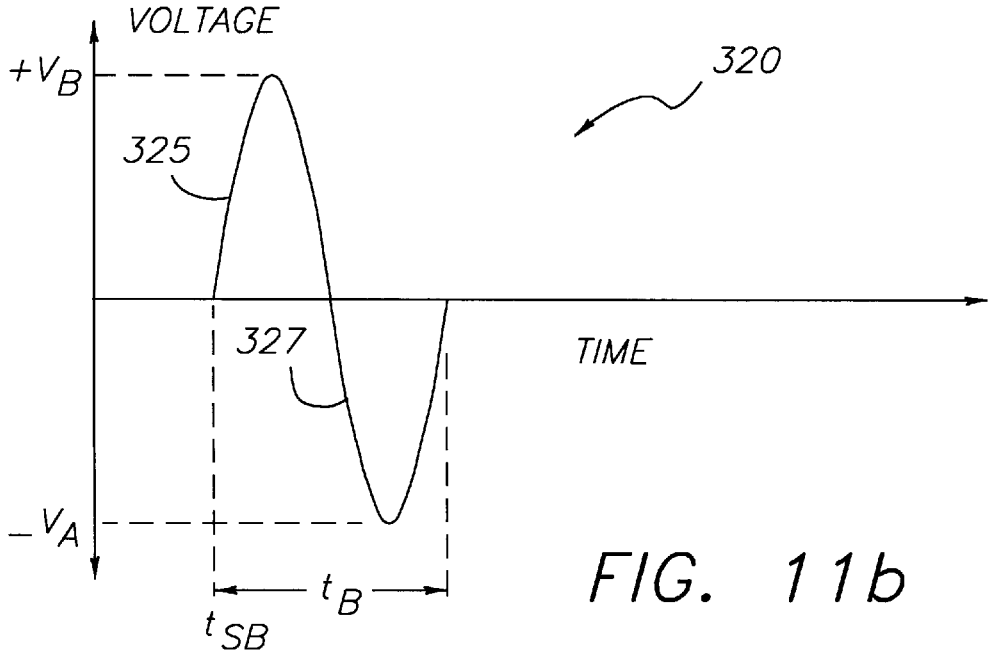
FIG. 11*b* is a graph illustrating a second "sinusoidally-varying" electrical pulse as a function of time applied to a second one of the ink channels, the second "sinusoidally-varying" electrical pulse having a predetermined amplitude, width and start time starting before the start time of the first "sinusoidally-varying" electrical pulse, the second "sinusoidally-varying" electrical pulse also having a positive polarity portion and a negative polarity portion.
Figure 12:
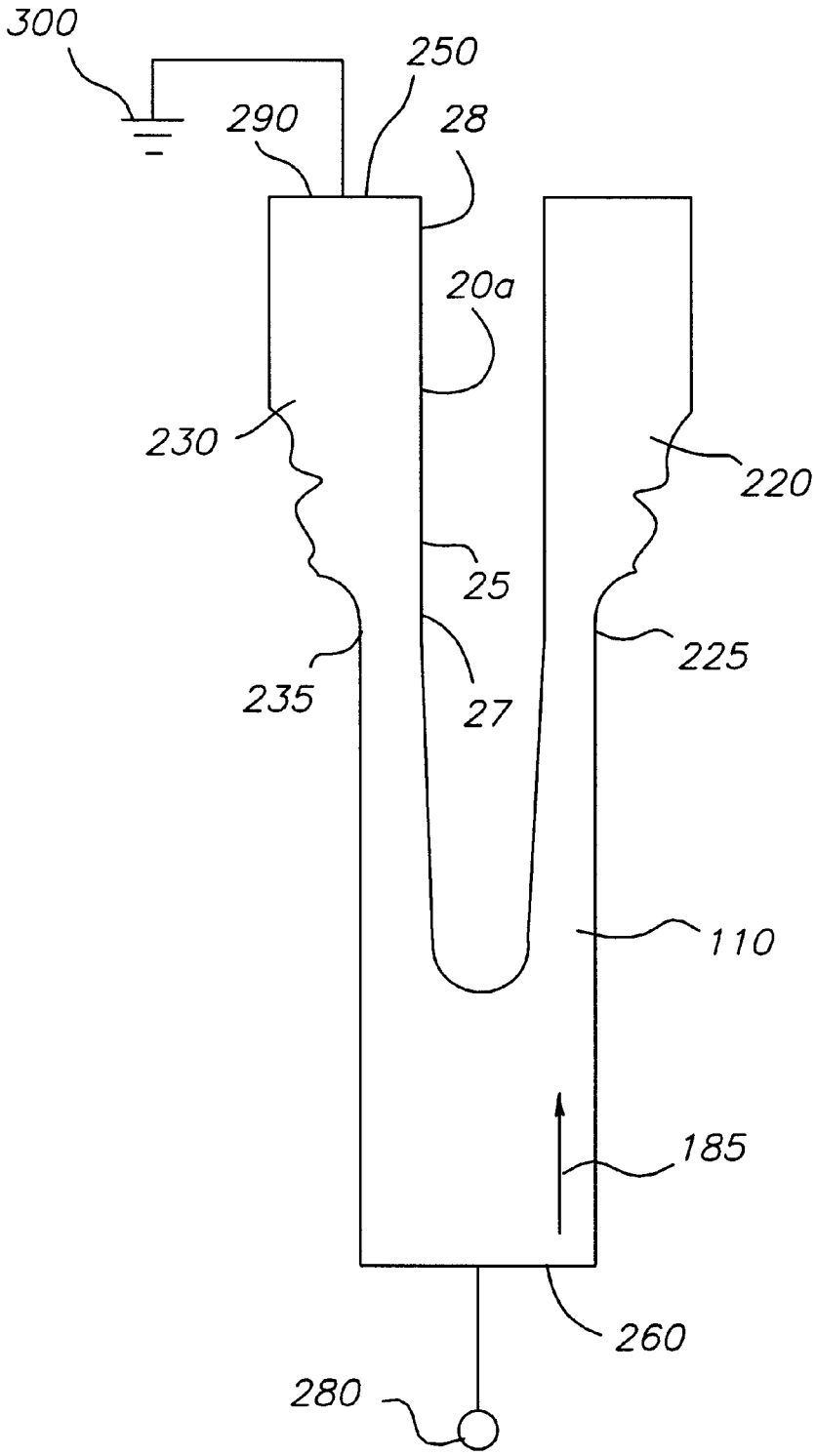
FIG. 12 is a view in elevation of side walls of an ink channel inwardly moving as the positive portion of the sinusoidally-varying electrical pulse is applied thereto.
Figure 13:
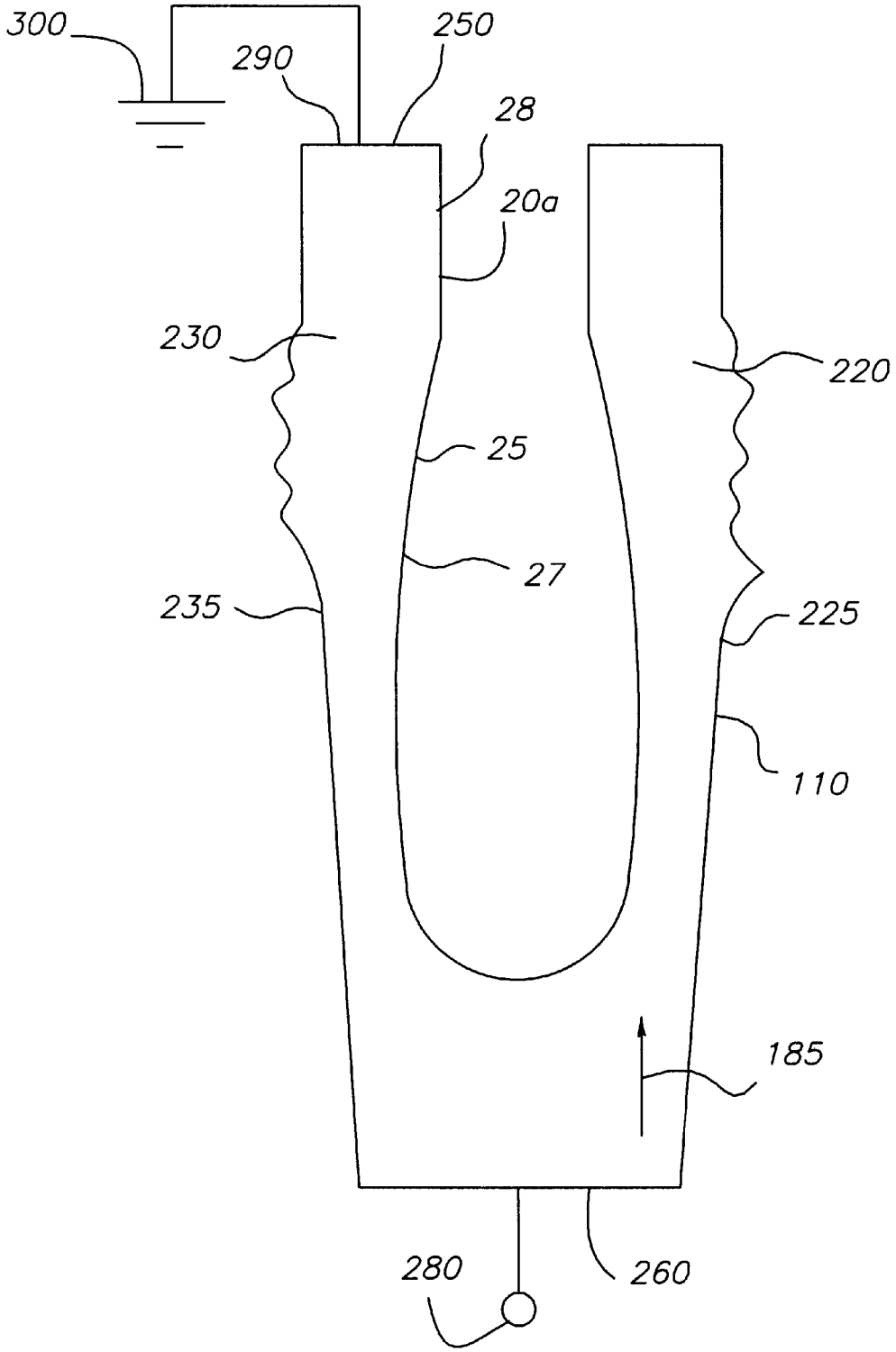
FIG. 13 is a view in elevation of side walls of an ink channel outwardly moving as the negative portion of the sinusoidally-varying electrical pulse is applied thereto.

Moreover, referring to FIGS. 11*a,* 11*b,* 12 and 13, it may be appreciated that an applied voltage of one polarity (i.e., either positive or negative polarity) will cause substrate 180 to bend in a first direction and an applied voltage of the opposite polarity will cause substrate 180 to deform in a second direction opposite to the first direction. For example, when a sinusoidally-varying pulse 320 having a positive polarity portion 325 and a negative polarity portion 327 is applied to actuator layer 270, side walls 220/230 will move inwardly and outwardly depending on whether the polarity of pulse 320 is positive or negative, respectively. More specifically, during the positive polarity portion 325, first side wall 220 and second side wall 230 will move inwardly to positions 220' and 230', as shown in FIG. 12. Similarly, during the negative polarity portion 327, first side wall 220 and second side wall 230 will move outwardly to positions 220" and 230", as shown in FIG. 13. Moreover, pulse 320 which is applied to channel 20*a* has a positive amplitude "$+V_A$" and a negative amplitude "$-V_A$". Also, pulse 320 which is applied to channel 20*a* also has a start time $t_{sA}$ and pulse width $\Delta t_A$. Similarly, pulse 320 which is applied to channel 20*b* has a positive amplitude "$+V_B$" and a negative amplitude "$-V_B$". Also, pulse 320 which is applied to channel 20*b* has a start time $t_{sB}$ and pulse width $\Delta t_B$. Start time $t_{sA}$ occurs after start time $t_{sB}$. This configuration of the invention allows greater volume of ink to be ejected during each droplet ejection cycle. This is so because, when side walls 220/230 outwardly move to positions 220"/230", volume of first channel 20*a* (or second channel 20*b,* as the case may be) increases to accommodate greater volume of ink therein before droplet 40 is ejected, which occurs when side walls 220/230 inwardly move to positions 220'/230'. It may be understood from the teachings herein, that when ejection of less volume of ink in each droplet 40 is desired, then sinusoidal pulse 320 is not supplied to actuator layer 270; rather, the "square-wave" pulse of FIGS. 9*a* and 9*b* or the "triangular-wave" pulse of FIGS. 10*a* and 10*b* is supplied. In this manner, printer apparatus 10 is capable of controlling ink droplet volume depending on whether pulse 310 is applied or pulse 320 is applied. Printer apparatus 10 is also capable of controlling ink droplet volume in yet another manner. In this regard, amplitude of pulse 310 or pulse 320 can be controlled by pulse generator 100 in order to control volume of ink forming ink droplet 40.

Figure 14:
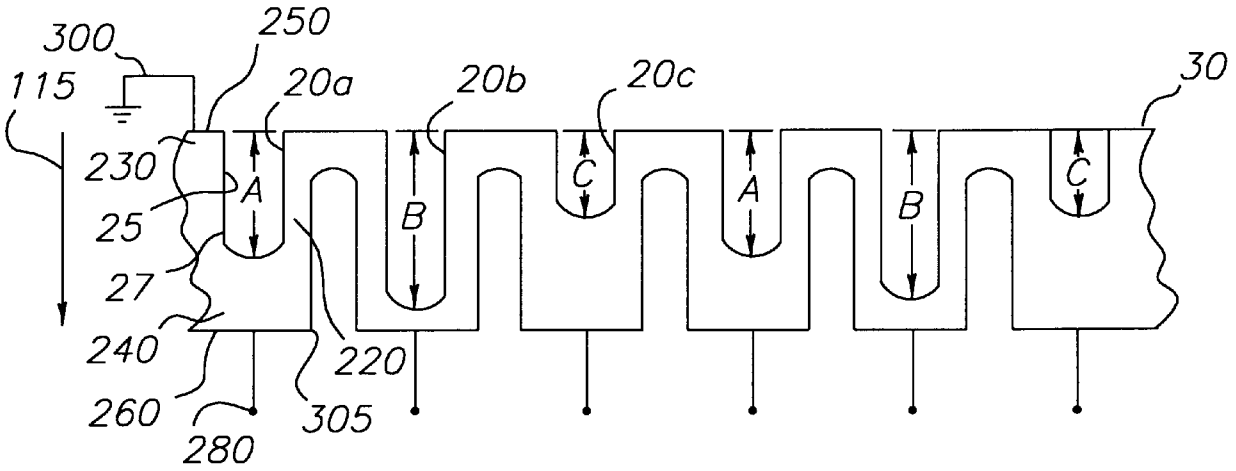
FIG. 14 is a view in elevation of another embodiment of the present invention showing the printhead with the nozzle plate removed.
Figure 15:
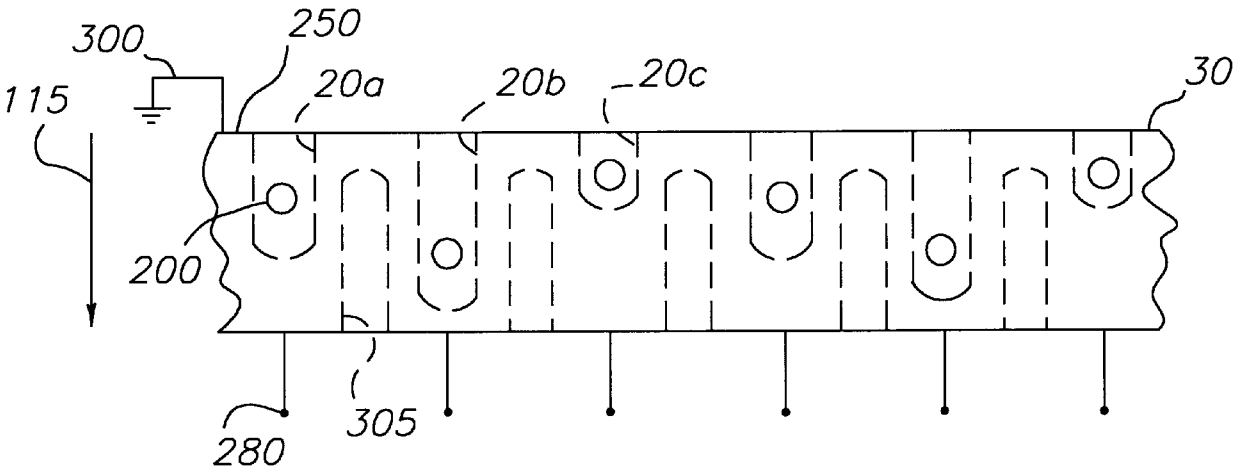
FIG. 15 is a view in elevation of the printhead shown in FIG. 14 with the nozzle plate present.

Turning now to FIGS. 14 and 15, an alternative embodiment of the present invention is there shown having first channel 20*a,* second channel 20*b* and a third channel 20*c* formed in printhead 30. Channels 20*a,* 20*b* and 20*c* have different depths "A", "B", and "C", respectively. Channels 20*c* has a depth "C" different from depths "A" and "B" and together define a second grouping of channels denoted herein as grouping "ABC". The grouping "ABC" may be arranged in a repeating series, as shown. In this manner, channels having the same depth are not located adjacent each other. The "AB" and the "ABC" groups are different to the extent that distance between ink channels for the two groups are different. For example, in the case of the "AB" group, channels 20*a*/20*b* may be simultaneously activated without mechanical cross-talk. This is so because the distance between channels 20*a* (or channels 20*b*) is two "channel widths". In the case of the "ABC" group, the channels 20*a*/20*b*/20*c* may be simultaneously activated without mechanical cross-talk. This is so because the distance between channels 20*a* (or channels 20*b,* or channels 20*c*) is three "channel widths". Thus, mechanical cross-talk is further reduced by this latter "ABC" configuration compared to the "AB" configuration because ink channels are further apart in the "ABC" grouping compared to the "AB" grouping. It may be appreciated that more than two groupings of channels may be provided. In addition, it may be appreciated that groupings of channels may be arranged in any suitable pattern, such as the periodic pattern (e.g., ABC, ABC) illustrated herein or a non-periodic pattern (e.g., ABCD, ABCA, ABCD), if desired.

Figure 16:
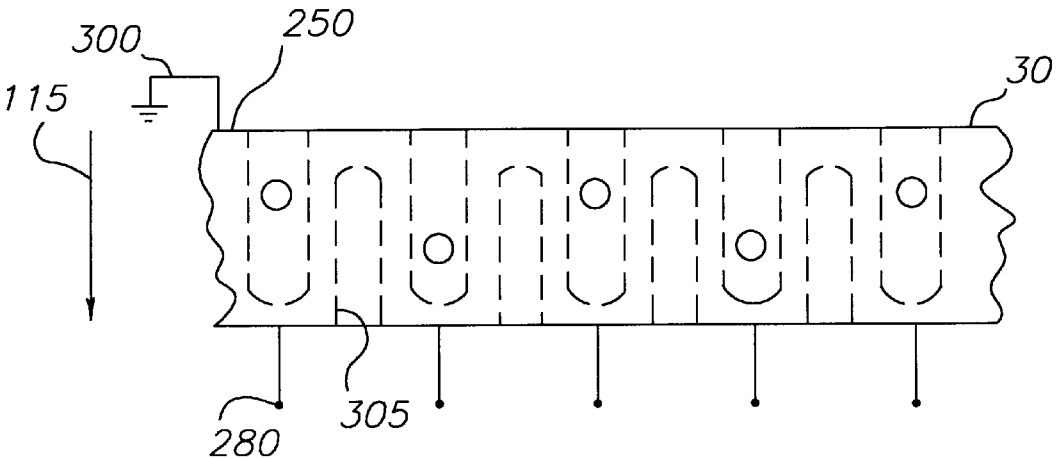
FIG. 16 is a view in elevation of yet another embodiment of the present invention showing a printhead with the nozzle plate removed, this view also showing the cutouts present but with channels having the same depths.

Referring to FIG. 16, another embodiment of the present invention is there shown for reducing mechanical and hydraulic cross-talk between neighboring channels 20*a*/20*b*. In this alternative embodiment of the invention, orifices 200 are again off-set; however, channels 20*a*/20*b* have the same depth. Mechanical and hydraulic cross-talk is reduced also in this embodiment of the invention because neighboring channels are not actuated simultaneously. This alternative embodiment of the invention reduces manufacturing costs because no provision need be made for machining channels of different depths.

Figure 17:
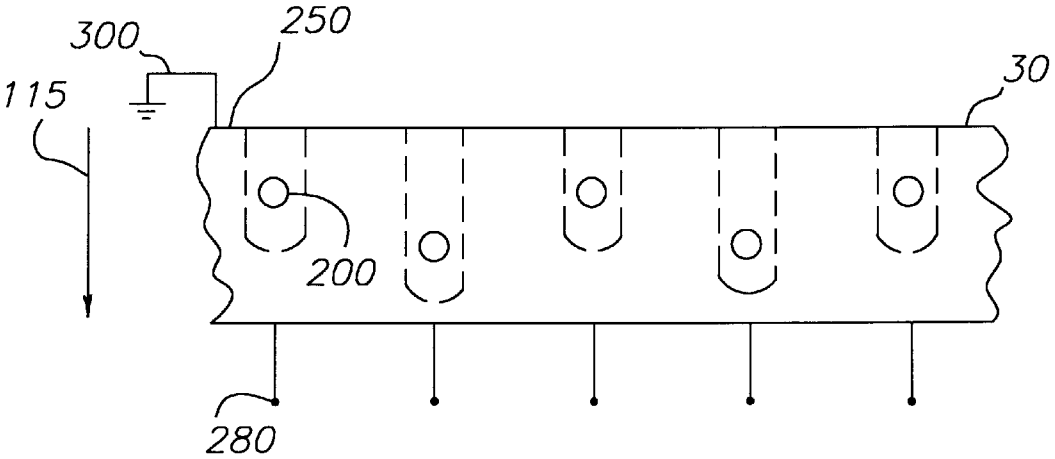
FIG. 17 is a view in elevation of still another embodiment of the present invention showing a printhead with the nozzle plate present, this view showing channels having different depths but without the cutouts.

Referring to FIG. 17, yet another embodiment of the present invention is there shown for reducing mechanical and hydraulic cross-talk between neighboring channels. In this alternative embodiment of the invention, channels 20*a*/20*b* have different depths and orifices 200 are again off-set. However, cutouts 305 are absent. Mechanical and hydraulic cross-talk is reduced also in this embodiment of the invention because neighboring channels are not actuated simultaneously. This alternative embodiment of the invention reduces manufacturing costs because no provision need be made for machining cutouts 305.

It is understood from the description hereinabove that an advantage of the present invention is that mechanical "cross-talk" between neighboring ink channels is reduced. This is so because presence of cutout 305 mechanically decouples one channel from its neighboring channel.

It is also understood from the description hereinabove that another advantage of the present invention is that mechanical and/or hydraulic "cross-talk" between neighboring ink channels is reduced because orifices 200 are off-set one from another. Orifices 200 are off-set so that neighboring channels are not actuated simultaneously. Such non-simultaneous actuation of neighboring ink channels results in reduced mechanical and hydraulic cross-talk between the channels.

The invention has been described in detail with particular reference to certain preferred embodiments thereof, but it will be understood that variations and modifications can be effected within the spirit and scope of the invention. For example, although the invention is described herein as suitable for ejecting ink droplets, the invention is equally suitable for ejecting droplets formed of other substances, such as clear liquid polymers (i.e., clear liquid plastics) used as a protective layer on photographs.

Moreover, as is evident from the foregoing description, certain other aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

Therefore, what is provided is a printer apparatus adapted to reduce cross-talk between ink channels therein, and method thereof.

PARTS LIST

A . . . depth of first ink channel 20*a*
B . . . depth of second ink channel 20*b*
C . . . depth of third ink channel 20*c*
$t_{sA}$ . . . start time for voltage applied to channel 20*a*
$t_{sB}$ . . . start time for voltage applied to channel 20*b*
$\Delta t_{sA}$ . . . voltage pulse width applied to channel 20*a*
$\Delta t_{sB}$ . . . voltage pulse width applied to channel 20*b*
$V_A$ . . . voltage pulse amplitude applied to channel 20*a*
$V_B$ . . . voltage pulse amplitude applied to channel 20*b*
10 . . . printer apparatus
20*a* . . . first ink channel
20*b* . . . second ink channel
20*c* . . . third ink channel
22 . . . ink body
25 . . . channel outlet
27 . . . end of ink channel
28 . . . open side of ink channel
30 . . . printhead
40 . . . ink droplet
50 . . . receiver
60 . . . image source
70 . . . image processor
80 . . . halftoning unit
90 . . . memory
100 . . . pulse generator
110 . . . actuator
115 . . . direction of movement of printhead
120 . . . transport mechanism
130 . . . transport control system
140 . . . controller
150 . . . ink pressure regulator
160 . . . ink reservoir
170 . . . conduit
180 . . . substrate
185 . . . arrow
190 . . . nozzle plate
200 . . . orifice
205 . . . first axis of alignment for orifices
207 . . . second axis of alignment for orifices
210 . . . top cover plate
220 . . . first side wall
220' . . . position of first side wall after inwardly moving
220" . . . position of first side wall after outwardly moving
225 . . . outside surface of first side wall
230 . . . second side wall
230' . . . position of second side wall after inwardly moving
230" . . . position of second side wall after outwardly moving
235 . . . outside surface of second side wall
240 . . . base portion
240' . . . position of base portion after inwardly moving
250 . . . top surface
260 . . . bottom surface
270 . . . electrode actuator layer
280 . . . electrical terminal
290 . . . common electrode layer
300 . . . ground
305 . . . cut-out
310 . . . electrical pulse
320 . . . sinusoidally-varying pulse
325 . . . positive portion of sinusoidally-varying pulse
327 . . . negative portion of sinusoidally-varying pulse

What is claimed is:

1. A printer apparatus, comprising:

(a) a substrate including a plurality of pairs of side walls off-set one from another, each pair of said side walls defining a channel therebetween, adjacent pairs of the side walls being separated by a cut-out, the channels having different depths; and (b) a cover connected to said substrate and having a plurality of orifices in registration with respective ones of the channels.

2. The apparatus of claim 1, further comprising an actuator connected to said side walls for actuating said side walls.

3. The apparatus of claim 2, further comprising a controller connected to said actuator for controlling said actuator.

4. A printer apparatus adapted to reduce cross-talk between a plurality of ink channels, comprising:

(a) a substrate including a plurality of spaced-apart pairs of selectively actuatable side walls defining respective ones of the channels therebetween for receiving associated ones of a plurality of ink bodies, said pairs of side walls being off-set one from another for reducing cross-talk between the ink bodies; and (b) a cover plate connected to said substrate and having a plurality of orifices therethrough off-set one from another and in registration with respective ones of the channels, whereby selected ones of the channels pressurize as selected off-set pairs of side walls actuate and whereby non-selected ones of the ink channels are pressure-free as the selected ones of the ink channels pressurize so that cross-talk between the channels is reduced.

5. The apparatus of claim 4, further comprising a plurality of actuators connected to respective pairs of said side walls for actuating said side walls.

6. The apparatus of claim 5, wherein said actuators are electrically actuatable.

7. The apparatus of claim 6, further comprising a pulse generator coupled to said actuators for supplying an electrical pulse to said actuators, so that said actuators are selectively electrically actuated.

8. The apparatus of claim 7, further comprising a controller connected to said pulse generator for controlling said pulse generator, so that said pulse generator controllably supplies the electrical pulse.

9. The apparatus of claim 4, wherein neighboring ones of said pairs of side walls are separated by a cut-out for further reducing cross-talk between ink bodies.

10. The apparatus of claim 4, wherein the channels defined by said side walls have different depths.

11. The apparatus of claim 4, wherein neighboring ones of said pairs of side walls are separated by a cut-out for further reducing cross-talk between the channels.

12. A printer apparatus adapted to reduce cross-talk between a plurality of ink channels having ink bodies disposed therein, comprising:

(a) a substrate including a plurality of spaced-apart pairs of selectively actuatable side walls formed of piezoelectric material, said side walls defining respective ones of the channels therebetween of different depths for receiving associated ones of the ink bodies, adjacent pairs of said side walls being off-set one from another for reducing cross-talk between the channels;

(b) a cover plate connected to said substrate and having a plurality of orifices therethrough off-set one from another and in registration with respective ones of the channels, whereby selected ones of the ink bodies pressurize as selected off-set pairs of side walls actuate and whereby non-selected ones of the ink bodies are pressure-free as the selected ones of the ink bodies pressurize, so that cross-talk between the ink bodies is reduced;

(c) a plurality of electrically actuatable actuators connected to respective pairs of said side walls for actuating said side walls;

(d) a pulse generator coupled to said actuators for supplying an electrical pulse to said actuators, so that said actuators are selectively electrically actuated; and (e) a controller connected to said pulse generator for controlling said pulse generator, so that said pulse generator controllably supplies the electrical pulse.

13. A printhead, comprising:

(a) two pairs of spaced-apart piezoelectric side walls defining two channels, respectively, said pairs of side walls being off-set one from another for reducing cross-talk between the channels, the channels having different depths, neighboring ones of said pairs of side walls being separated by a cut-out for further reducing cross-talk between channels;

(b) a cover plate connected to said side walls and spanning the channels, said cover plate having a plurality of orifices off-set one from another and in registration with respective ones of the channels; and (c) a plurality of actuators connected to respective pairs of said side walls for actuating said side walls.

14. The printhead of claim 13, further comprising a pulse generator coupled to said actuators for supplying an electrical pulse to said actuators, so that said actuators are selectively electrically actuated.

15. In a printer, a method of reducing cross-talk, comprising the steps of:

(a) using a substrate including a plurality of pairs of side walls off-set one from another, each pair of said side walls defining a channel therebetween, the pairs of sidewalls being separated by a cut-out, the channels having different depths; and (b) connecting a cover to the substrate, the cover having a plurality of orifices in registration with respective ones of the channels.

16. The method of claim 15, further comprising the step of connecting an actuator to the side walls for actuating the side walls.

17. The method of claim 16, further comprising the step of connecting a controller to the actuator for controlling the actuator.

18. In a printer, a method of reducing cross-talk between a plurality of ink channels disposed therein, comprising the steps of:

(a) using a substrate including a plurality of spaced-apart pairs of selectively actuatable side walls defining respective ones of the channels therebetween, the pairs of side walls being off-set one from another for reducing cross-talk between the channels; and (b) connecting a cover plate to the substrate, the substrate having a plurality of orifices therethrough off-set one from another and in registration with respective ones of the channels, whereby selected ones of the ink channels pressurize as selected off-set pairs of side walls actuate and whereby non-selected ones of the ink channels are pressure-free as the selected ones of the ink channels pressurize to reduce cross-talk between the ink channels is reduced.

19. The method of claim 18, further comprising the step of connecting a plurality of actuators to respective pairs of the side walls for actuating the side walls.

20. The method of claim 19, wherein the step of connecting a plurality of actuators comprises the step of connecting a plurality of electrically actuatable actuators.

21. The method of claim 19, further comprising the step of coupling a pulse generator to the actuators for supplying an electrical pulse to the actuators, so that the actuators are selectively electrically actuated.

22. The method of claim 21, further comprising the step of connecting a controller to the pulse generator for controlling the pulse generator, so that the pulse generator controllably supplies the electrical pulse.

23. The method of claim 18, wherein the step of using a substrate comprises the step of using a substrate having neighboring ones of the pairs of side walls separated by a cut-out for further reducing cross-talk between channels.

24. The method of claim 18, wherein the step of using a substrate comprises the step of using a substrate wherein the channels defined by said pairs of side walls have different depths.

25. In a printer, a method of reducing cross-talk between a plurality of ink channels having ink bodies disposed therein, comprising the steps of:

(a) using a piezoelectric substrate including a plurality of spaced-apart pairs of selectively actuatable side walls formed of piezoelectric material, the side walls defining respective channels therebetween of different depths for receiving the ink bodies, the pairs of the side walls being off-set one from another for reducing cross-talk between ink bodies;

(b) connecting a cover plate to the substrate, the cover plate having a plurality of orifices therethrough off-set one from another and in registration with respective ones of the channels, whereby selected ones of the ink bodies pressurize as the off-set pairs of side walls actuate and whereby non-selected ones of the ink channels are pressure-free as the selected ones of the ink bodies pressurize to reduce cross-talk between the ink bodies;

(c) connecting a plurality of electrically actuatable actuators to respective pairs of the side walls for actuating the side walls;

(d) coupling a pulse generator to the actuators for supplying an electrical pulse to the actuators, so that the actuators are selectively electrically actuated; and (e) connecting a controller to the pulse generator for controlling the pulse generator, so that the pulse generator controllably supplies the electrical pulse.

26. The method of claim 25, wherein the step of using a substrate comprises the step of using a substrate having neighboring ones of the pairs of side walls separated by a cut-out for further reducing cross-talk between ink bodies.

27. In a printhead, a method of reducing cross-talk, comprising the steps of:

(a) using two spaced-apart pairs of side walls defining two channels, respectively, the pairs of the side walls being off-set one from another for reducing mechanical coupling between the channels, the channels having different depths, neighboring ones of the pairs of side walls being separated by a cut-out for further reducing mechanical coupling between channels; and (b) connecting a cover plate to the side walls, the cover plate spanning the channels, the cover plate having a plurality of orifices off-set one from another and in registration with respective ones of the channels.

28. The method of claim 27, further comprising the step of connecting a plurality of actuators to respective pairs of the side walls for actuating the side walls.

29. The method of claim 28, further comprising the step of coupling a pulse generator to the actuators for supplying an electrical pulse to the actuators, so that the actuators are selectively electrically actuated.

* * * * *